US007644874B2

(12) United States Patent
Mochizuki et al.

(10) Patent No.: US 7,644,874 B2
(45) Date of Patent: Jan. 12, 2010

(54) INJECTOR

(75) Inventors: Kouichi Mochizuki, Anjo (JP); Moriyasu Gotoh, Toyohashi (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 12/060,517

(22) Filed: Apr. 1, 2008

(65) Prior Publication Data

US 2008/0245891 A1 Oct. 9, 2008

(30) Foreign Application Priority Data

Apr. 4, 2007 (JP) ..... 2007-098255

(51) Int. Cl.
*F02M 41/16* (2006.01)

(52) U.S. Cl. ..... 239/96; 239/102.2; 239/533.12; 239/584; 123/498; 251/129.06

(58) Field of Classification Search ..... 239/88, 239/96, 102.1, 102.2, 533.12, 584; 123/498; 251/129.06

See application file for complete search history.

(56) References Cited

U.S. PATENT DOCUMENTS 4,635,849 A * 1/1987 Igashira et al. ..... 239/102.2
6,499,471 B2 * 12/2002 Shen et al. ..... 123/498
6,676,035 B2 * 1/2004 Lorraine et al. ..... 239/102.2
6,766,965 B2 * 7/2004 D'Arrigo ..... 239/102.2
7,455,244 B2 * 11/2008 Boecking ..... 239/102.2
2007/0152084 A1 7/2007 Boecking
2007/0215714 A1 9/2007 Horiuchi et al.
2008/0093484 A1 4/2008 Stoecklein et al.

FOREIGN PATENT DOCUMENTS

JP 11-200981 7/1999
JP 2006-152907 6/2006
JP 2006-214317 8/2006
JP 3882240 11/2006

OTHER PUBLICATIONS

Japanese Office Action dated Dec. 9, 2008 issued in counterpart Japanese Application No. 2007-98255, with English translation.

* cited by examiner

*Primary Examiner*—Steven J Ganey
(74) *Attorney, Agent, or Firm*—Nixon & Vanderhye, PC

(57) ABSTRACT

In an injector, a first shaft portion of a needle is slidably supported by a first sleeves which is loosely received in a first internal chamber, and a second shaft portion of the needle is slidably supported in a body. Thereby, the first and second shaft portions are supported by the different members, and a relatively large clearance is formed on a radially outer side of the first sleeve.

13 Claims, 5 Drawing Sheets

INJECTOR

CROSS REFERENCE TO RELATED APPLICATION

This application is based on and incorporates herein by reference Japanese Patent Application No. 2007-98255 filed on Apr. 4, 2007.

BACKGROUND OF THE INVENTION

1. Field of the Invention

The present invention relates to an injector.

2. Description of Related Art

With respect to an injector of an internal combustion engine, which includes a needle that is slidable in a valve opening direction and a valve closing direction to open and close an injection hole, industrial research and development has been made to increase a drive force for implementing the valve opening and thereby to improve an injection response. As a result of the research and development, a technique for constructing an actuator using a drive element (e.g., a piezoelectric element or a magnetostrictor), which generates an expansion force, has been proposed to increase the drive force.

An example of a prior art injector 100, which uses such an expansion force, is shown in FIG. 4 (see, for example, WO 2005/075811 corresponding to US2007/0152084A1). The injector 100 includes a needle 102, a piezoelectric actuator 103, a piston 104 and an outer sleeve 106. The needle 102 opens and closes an injection hole 101. The piezoelectric actuator 103 has a piezoelectric element and axially expands and contracts. The piston 104 is axially moved back and forth in response to the contraction and expansion of the piezoelectric actuator 103. The outer sleeve 106 is located radially outward of the piston 104 and slidably supports the piston 104. Furthermore, the outer sleeve 106 defines a fuel pressure chamber 105, a volume of which is increased and decreased in response to the backward movement and forward movement, respectively, of the piston 104.

In this injector 100, the needle 102 is installed in such a manner that the needle 102 receives a fuel pressure of the pressure chamber 105 in the valve opening direction (the upward direction in FIG. 4). That is, the needle 102 is installed such that a distal end surface of a first shaft portion 107 (forming a rear end portion of the needle 102) forms a pressure receiving surface 108, so that the needle 102 receives the fuel pressure toward the rear end side through the pressure receiving surface 108 of the first shaft portion 107. Thereby, the needle 102 defines the pressure chamber 105.

In the injector 100, the high pressure fuel, which is supplied from a fuel supply source (e.g., a common rail), is guided to a nozzle chamber 109. Furthermore, through expansion of the piezoelectric actuator 103, the piston 104 is displaced toward the distal end side to increase the fuel pressure of the pressure chamber 105. In this way, the needle 102 is lifted in the valve opening direction to open the injection hole 101, so that the fuel of the nozzle chamber 109 is injected into a corresponding cylinder from the injection hole 101.

However, in the above injector 100, the first shaft portion 107 is placed radially inward of the piston 104 (i.e., the piston 104 and the first shaft portion 107 are arranged in parallel with each other along the axial direction), so that an outer diameter of the injector 100 is disadvantageously increased. Furthermore, it is difficult to place a stopper, which limits the amount of lift of the needle 102. Furthermore, the displacement direction of the piston 104 and the displacement direction of the needle 102 are opposite to each other. Thus, the relative slide speed of the first shaft portion 107 relative to the piston 104 is relatively large, so that slide wearing, which occurs between the piston 104 and the first shaft portion 107, is prominent.

In order to address the above disadvantage, another injector 100 shown in FIGS. 5A and 5B has been proposed (see, for example, Japanese Unexamined Patent publication No. 2006-152907). In the injector of FIGS. 5A and 5B, the piston 104 and the first shaft portion 107 are arranged in series in the axial direction, so that the outer diameter of the injector 100 can be advantageously reduced. Furthermore, the pressure application surface 111 of the piston 104 and the pressure receiving surface 108 of the firs shaft portion 107 are separated from each other and define different chambers, respectively.

Specifically, in the injector 100 of FIGS. 5A and 5B, the pressure receiving surface 108 defines a control chamber 112, which is separated from the pressure chamber 105, and the pressure receiving surface 108 receives the fuel pressure of the control chamber 112 toward the rear end side of the injector. Furthermore, similar to the injector 100 of FIG. 4, the pressure application surface 111 of the injector 100 of FIGS. 5A and 5B defines the pressure chamber 105 and applies the pressure o the fuel of the pressure chamber 105 toward the distal end side. Also, the pressure chamber 105 and the control chamber 112 are communicated with each other through a communication passage 114, which is provided in a body 113. Furthermore, a fuel chamber 116, which is communicated with a fuel flow passage 115, is formed on a rear end side of the first shaft portion 107.

With the above described structure, in the injector 100, the piston 104 is displaced toward the distal end side by the expansion of the piezoelectric actuator 103 to increase the fuel pressure of the pressure chamber 105, so that the fuel of the increased pressure is supplied to the control chamber 112 to lift the needle 102 in the valve opening direction to open the injection hole 101 and thereby to inject fuel from the injection hole 101 (see FIG. 5B).

With the above described structure of FIGS. 5A and 5B, it is possible to reduce the outer diameter of the injector 100. Also, at the time of lifting of the needle 102, the fuel outflows from the fuel chamber 116, and the portion of the body 113, which is located at the rear end of the fuel chamber 116, functions as a stopper of the needle 102. Furthermore, the needle 102 slidably engages only with the body 113, so that the relative slide speed of the needle 102 is reduced, and thereby the slide wearing can be alleviated.

However, in the injector 100 of FIGS. 5A and 5B, the first shaft portion 107 and the second shaft portion 117 of the needle 102 are both slidably supported in the common body 113. Therefore, in order to lift the needle 102 while maintaining the required fluid tightness of the control chamber 112, a clearance, which is located radially outward of the first and second shaft portions 107, 117, needs to be limited to equal to or smaller than a predetermined value, and concentricity of the first and second shaft portions 107, 117 at the time of displacement of the first and second shaft portions 107, 117 needs to be maintained. Therefore, the needle 102 and the body 113 need to be manufactured with the high accuracy. As a result, in the case of the injector 100 of FIGS. 5A and 5B, the number of manufacturing steps is disadvantageously increased.

SUMMARY OF THE INVENTION

The present invention is made in view of the above disadvantages. Thus, it is an objective of the present invention to provide an injector, which enables a reduction of a required manufacturing accuracy of a needle and a support member thereof to permit a reduction in a number of manufacturing steps.

To achieve the objective of the present invention, there is provided an injector, which includes a needle, a sleeve, a body, an actuator, a piston and a control chamber. The needle is slidable in a valve opening direction and a valve closing direction to respectively open and close an injection hole, which is located at a distal end side of the injector. The needle includes a first shaft portion and a second shaft portion, which are separately supported in an axially slidably manner. The second shaft portion is located on a distal end side of the first shaft portion and has an outer diameter smaller than that of the first shaft portion. The sleeve slidably supports the first shaft portion. The body loosely receives the sleeve therein. The actuator axially expands and contracts to drive the needle. The piston is axially moved forward and backward in response to expansion and contraction, respectively, of the actuator. In the control chamber, a fuel pressure is increased and decreased in response to forward movement and backward movement, respectively, of the piston. The control chamber applies the fuel pressure to the first shaft portion in the valve opening direction of the needle. When the actuator is expanded, the piston is moved forward to increase the fuel pressure in the control chamber, so that the needle is lifted away from the injection hole to open the injection hole. When the sleeve is urged toward the distal end side and is thereby seated against an internal surface of the body, the control chamber is defined by an inner peripheral surface of the sleeve, the internal surface of the body and an outer peripheral surface of a portion of the needle, which is located on a distal end side of the first shat portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
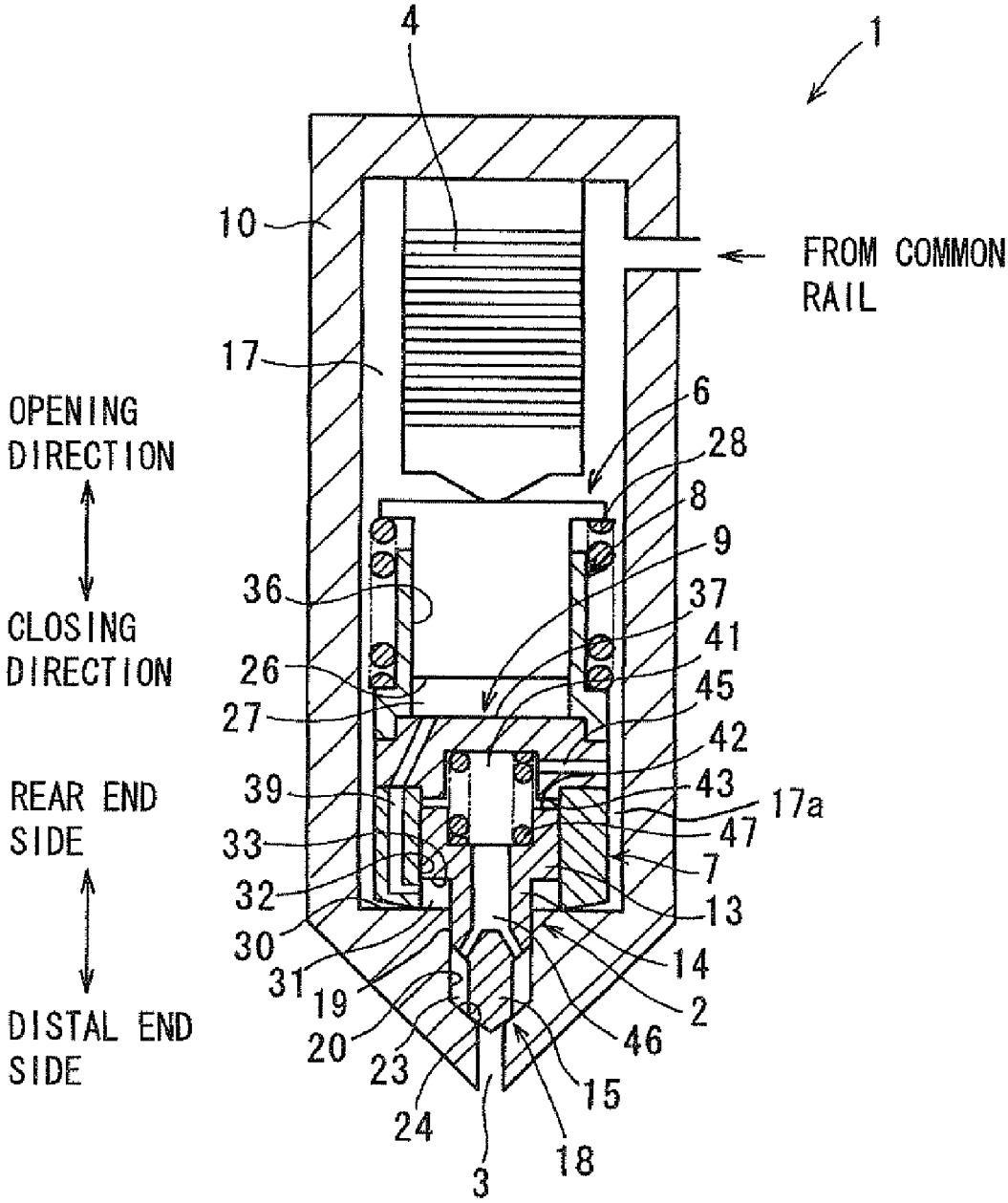
FIG. 1 is a schematic longitudinal cross sectional view of a fuel injector according to a first embodiment of the present invention.

A structure of an injector 1 according to a first embodiment of the present invention will be described with reference to FIG. 1.

The injector 1 is installed in an undepicted internal combustion engine of a direct-injection type (e.g., a diesel engine) and directly injects high pressure fuel, which is received from a common rail, into a corresponding cylinder of the engine. The injector 1 injects fuel by lifting a needle 2 in a valve opening direction (the upward direction in FIG. 1) to open an injection hole 3, which is provided in a distal end side of the injector 1. Furthermore, in the injector 1, a piezoelectric element, which expands upon application of a voltage thereto, forms an actuator 4, and an expansion force of the piezoelectric element is used as the drive force to drive the needle 2.

The injector 1 includes the needle 2, the actuator 4, a piston 6, a first sleeve 7, a second sleeve 8, a flange 9 and a body 10. The needle 2 opens and closes the injection hole 3 that extends through a wall of the body 10. The actuator 4 axially expands and contracts. The piston 6 axially moves back and forth in response to the contraction and expansion, respectively, of the actuator 4. The first sleeve 7 slidably supports the needle 2. The second sleeve 8 slidably supports the piston 6. The flange 9 is axially placed between the first sleeve 7 and the second sleeve 8 and axially spaces the piston 6 from the needle 2. The first sleeve 7, the second sleeve 8 and the flange 9 are loosely received in the body 10.

A rear end portion of the needle 2 forms a first shaft portion 13, which is supported by the first sleeve 7. Furthermore, in the needle 2, a second shaft portion 14, which has an outer diameter smaller than that of the first shaft portion 13, is provided on a distal end side of the first shaft portion 13 and is slidably supported by the body 10. Also, in the needle 2, a valve portion 15, which has an outer diameter smaller than that of the second shaft portion 14, is provided on a distal end side of the second shaft portion 14 (i.e., at a distal end portion of the needle) to open and close the injection hole 3. That is, the needle 2 opens and closes the injection hole 3 by axially sliding the first and second shaft portions 13, 14, which are individually and separately supported by the first sleeve 7 and the body 10, respectively, in a slidable manner.

The body 10 includes a first internal chamber 17 and a second internal chamber 18. The first internal chamber 17 receives the first sleeve 7, the second sleeve 8 and the flange 9 and has an inner diameter larger than that of the second internal chamber 18. An outer peripheral surface 19 of the second shaft portion 14 slidably engages an inner peripheral surface 20 of the second internal chamber 18. That is, the second shaft portion 14 is slidably supported by the body 10 on the distal end side of the first sleeve 7.

Furthermore, the first sleeve 7, the second sleeve 8 and the flange 9 are disposed axially adjacent to each other in the order of the first sleeve 7, the flange 9 and the second sleeve 8 from the distal end side toward the rear end side of the injector 1. Additionally, in the first internal chamber 17, a gap 17*a* (outer peripheral chamber), which is defined between the outer peripheral surfaces of the first and second sleeves 7, 8 and of the flange 9 and the inner peripheral surface of the first internal chamber 17 is filled with high pressure fuel received from the common rail.

Furthermore, a space, which is defined between the outer peripheral surface of the valve portion 15 and the inner peripheral surface 20 of the second internal chamber 18, forms a nozzle chamber 23, into or out of which fuel flows to exert a fuel pressure on the needle 2 in a valve opening direction. Additionally, a seat surface 24 is formed at a distal end side part of the inner peripheral surface 20. The valve portion 15 is seated against and is lifted away from the seat surface 24. The injection hole 3 opens at a distal end of the seat surface 24. When the valve portion 15 is lifted away from the seat surface 24, the nozzle chamber 23 is communicated with the injection hole 3. Thus, fuel of the nozzle chamber 23 is injected from the injection hole 3 into the corresponding cylinder of the engine. In contrast, when the valve portion 15 is seated against the seat surface 24, the nozzle chamber 23 is discommunicated from the injection hole 3. Thus, the injection of the fuel of the nozzle chamber 23 from the injection hole 3 is stopped.

A rear end of the actuator 4 is fixed to the body 10, and a distal end of the actuator 4 contacts a rear end surface of the piston 6. In this way, when the actuator 4 receives the voltage, the actuator 4 exerts the expansion force toward the distal end thereof to urge the piston 6 toward the distal end side thereof. The actuator 4 is received in the first internal chamber 17 together with the first sleeve 7, the second sleeve 8 and the flange 9.

A distal end surface of the piston 6 defines a pressure chamber 27 described below. Additionally, the piston 6 is displaced by the expansion force of the actuator 4 toward the distal end side to increase the fuel pressure of the pressure chamber 27. That is, the distal end surface 26 of the piston 6 forms a pressure application surface for increasing the fuel pressure of the pressure chamber 27. Furthermore, when the application of the voltage to the actuator 4 is stopped, the expansion force is no longer produced. Thus, the piston 6 is urged by a first spring 28 described below toward a rear end side.

When the first sleeve 7 is urged toward the distal end side and is seated against an internal surface 30 of the first internal chamber 17, the first sleeve 7 defines a control chamber 31 in corporation with the needle 2 and the body 10. That is, the control chamber 31 is defined by an inner peripheral surface 32 of the first sleeve 7, the outer peripheral surface 19 of the second shaft portion 14, a distal end surface 33 of the first shaft portion 13, and the internal surface 30 of the first internal chamber 17.

The distal end surface 33 serves as a pressure receiving surface, which receives the fuel pressure applied toward the rear end side, so that the needle 2 is urged in the valve opening direction by the fuel pressure of the control chamber 31. The first sleeve 7 is urged by the first spring 28 through the second sleeve 8 and the flange 9 toward the distal end side and is seated against the internal surface 30.

The second sleeve 8 forms the pressure chamber 27 in corporation with the piston 6 and the flange 9. That is, the pressure chamber 27 is defined by the inner peripheral surface 36 of the second sleeve 8, the distal end surface 26 and the rear end surface 37 of the flange 9. As described above, the distal end surface 26 functions as the pressure application surface, so that the fuel pressure in the pressure chamber 27 is increased and decreased by the pressure applied from the distal end surface 26. That is, the volume of the pressure chamber 27 is decreased and increased in response to the forward movement and the backward movement, respectively, of the piston 6 to increase and decrease the fuel pressure of the pressure chamber 27.

The pressure chamber 27 is communicated with the control chamber 31 through a communication passage (communication hole) 39. Thus, when the fuel pressure of the pressure chamber 27 is increased and decreased, the fuel pressure of the control chamber 31 is also increased and decreased. That is, the fuel pressure of the control chamber 31 is increased and decreased in response to the forward movement and the backward movement of the piston 6. The communication passage 39 extends through the flange 9 and the first sleeve 7 and is isolated, i.e., separated from the first internal chamber 17, which is located radially outward of the flange 9 and the first sleeve 7 and is filled with the high pressure fuel.

Furthermore, the first spring 28 is placed between the distal end portion of the second sleeve 8 and the rear end portion of the piston 6. The first spring 28 axially urges the second sleeve 8 and the piston 6 in the opposite directions, respectively. The second sleeve 8 is urged by the first spring 28 toward the distal end side, so that the first sleeve 7 is seated against the internal surface 30 of the body 10 through the second sleeve 8 and the flange 9. Furthermore, the first spring 28 urges the piston 6 toward the rear end side, so that the first spring 28 serves as a restoring spring for restoring the piston 6 and provides a compressive preload to the actuator 4 through the piston 6.

The flange 9 defines a backpressure chamber 41 in cooperation with the first sleeve 7 and the needle 2. The fuel, which exerts the fuel pressure against the needle 2 in the valve closing direction, flows into and out of the backpressure chamber 41. That is, the inner peripheral surface 32, a rear end surface 42 of the first shaft portion 13 and a distal end surface 43 of the flange 9 define the backpressure chamber 41. The rear end surface 42 of the first shaft portion 13 of the needle 2 receives the fuel pressure of the backpressure chamber 41 in the valve closing direction. The distal end surface 43 of the flange 9 contacts the rear end surface 42 when the needle 2 is lifted toward the rear end side. That is, the flange 9 functions as a stopper that limits the amount of lift of the needle 2.

The backpressure chamber 41 communicates with the first internal chamber 17 through a communication passage (communication hole) 45 provided in the flange 9, so that fuel is communicated between the backpressure chamber 41 and the first internal chamber 17 (more specifically, the outer peripheral chamber 17*a*) through the communication passage 45. The backpressure chamber 41 is communicated with the nozzle chamber 23 through a communication passage (communication hole) 46, which is provided in the second shaft portion 14. Furthermore, the backpressure chamber 41 receives a second spring 47, which urges the needle 2 in the valve closing direction.

The distal end portion of the flange 9 is fitted into the first sleeve 7, so that the flange 9 and the first sleeve 7 are radially positioned relative to each other. Also, the rear end portion of the flange 9 is fitted into the second sleeve 8, so that the flange 9 and the second sleeve 8 are radially positioned relative to each other.

With the aforementioned arrangement, when the voltage is applied to the actuator 4, the piston 6 is displaced toward the distal end side to increase the fuel pressure of the pressure chamber 27. Thereby, the fuel, which is pressurized in the pressure chamber 27, flows into the control chamber 31 through the communication passage 39. Thus, the fuel pressure of the control chamber 31 is increased, so that the needle 2 is driven in the valve opening direction. Accordingly, the injection hole 3 is opened, so that the fuel of the nozzle chamber 23 is injected through the injection hole 3.

At this time, the fuel of the backpressure chamber 41 flows into the first internal chamber 17 through the communication passage 45. The amount of lift of the needle 2 is limited when the first shaft portion 13 contacts the flange 9. The high pressure fuel of the first internal chamber 17 flows into the nozzle chamber 23 through the communication passage 45, the backpressure chamber 41 and the communication passage 46.

When the application of the voltage to the actuator 4 is stopped, the fuel pressure of the pressure chamber 27 is no longer increased, so that the fuel pressure of the control chamber 31 is decreased. Thereby, the needle 2 is urged by the second spring 47 in the valve closing direction (the downward direction in FIG. 1), so that the injection hole 3 is closed to stop the injection of fuel. Furthermore, the high pressure fuel of the first internal chamber 17 flows into the backpressure chamber 41 through the communication passage 45, so that the piston 6 is urged by the first spring 28 and is thereby displaced toward the rear end side.

Now, advantages of the first embodiment will be described.

The injector 1 of the first embodiment includes the first sleeve 7, which slidably supports the first shaft portion 13, and the first sleeve 7 is loosely inserted into the first internal chamber 17 to define the outer peripheral chamber 17*a* at the radially outward of the first sleeve 7. Furthermore, the second shaft portion 14 is slidably supported by the body 10 on the distal end side of the first sleeve 7.

Thereby, the first shaft portion 13 and the second shaft portion 14 are slidably supported by the different members (specifically, the first sleeve 7 and the body 10), respectively, and the relatively large clearance (the outer peripheral chamber 17*a*) is formed on the radially outer side of the first sleeve 7. Accordingly, the first sleeve 7, which supports the first shaft portion 13, and the body 10, which supports the second shaft portion 14, can change the radial relative position therebetween. As a result, without a need for highly accurately manufacturing the needle 2, the first sleeve 7 and the body 10 near the second internal chamber 18, clearances, which are respectively located radially outward of the first and second shaft portions 13, 14, can be limited equal to or less than a predetermined amount. Also, it is possible to ensure the concentricity (coaxiality) of the first and second shaft portions 13, 14 at the time of displacement of the first and second shaft portions 13, 14.

As described above, since the needle 2, the first sleeve 7 and the body 10 need not to be manufactured with high accuracy, the manufacturing steps of the injector 1 can be reduced.

Furthermore, the second sleeve 8 and the flange 9 are formed separately, and the rear end portion of the flange 9 is fitted into the second sleeve 8, so that the second sleeve 8 and the flange 9 are radially positioned relative to each other.

Thereby, the inner peripheral surface 36 of the second sleeve 8 and the rear end surface 37 of the flange 9, which define the pressure chamber 27, can be highly accurately manufactured. Therefore, the volume of the pressure chamber 27 can be accurately set, and the control accuracy of the fuel pressure of the control chamber 31 and the control accuracy of the lifting of the needle 2 can be improved.

Furthermore, the first spring 28 urges the second sleeve 8 and the piston 6 in the opposite axial directions, respectively.

Therefore, the first sleeve 7 can be seated against the internal surface 30 of the body 10 by urging the second sleeve 8 toward the distal end side with the first spring 28, and the compression preload can be applied to the actuator 4 by urging the piston 6 toward the rear end side with the first spring 28.

Furthermore, the fuel can freely flow between the backpressure chamber 41 and the first internal chamber 17 through the communication passage 45.

Thereby, the fuel pressure of the backpressure chamber 41 can be stably maintained to a generally constant value, and the volume of the backpressure chamber 41 can be rapidly increased and decreased. Therefore, the response of the needle 2 can be improved.

Furthermore, the first sleeve 7, which defines the backpressure chamber 41, is formed separately from the flange 9, and the distal end portion of the flange 9 is fitted into the first sleeve 7, so that the first sleeve 7 and the flange 9 are radially positioned relative to each other.

This allows manufacturing of the first sleeve 7 and the flange 9 with high accuracy. Therefore, it is possible to highly accurately set the amount of lift of the needle 2 relative to the flange 9, which serves as the stopper of the needle 2.

Furthermore, the backpressure chamber 41 receives the second spring 47, which urges the needle 2 in the valve closing direction.

Thereby, the speeding up of the valve closing movement of the needle 2 is possible, so that the response of the needle 2 at the time of the valve closing can be further improved.

Second Embodiment

Figure 2:
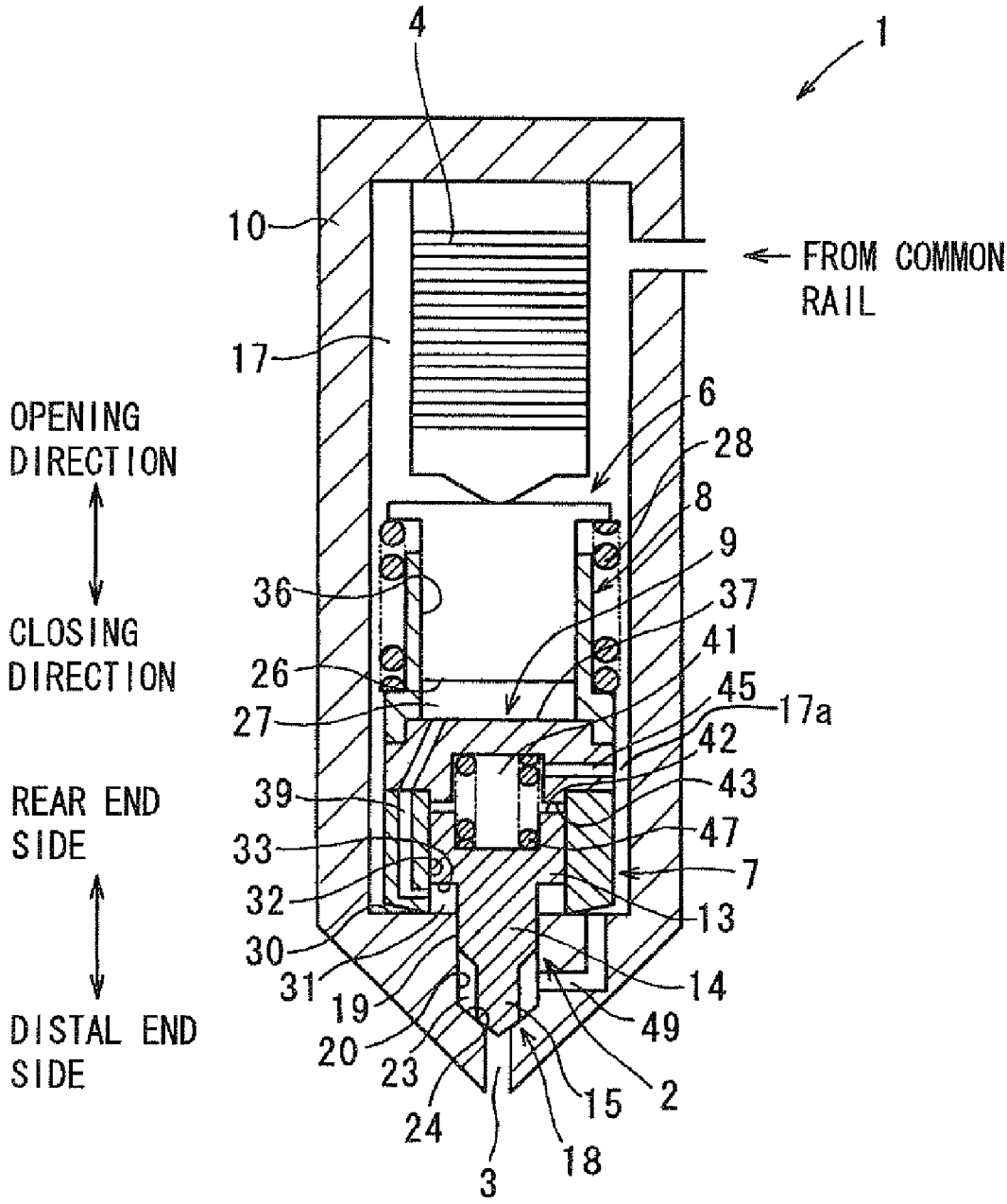
FIG. 2 is a schematic longitudinal cross sectional view of a fuel injector according to a second embodiment of the present invention.

With reference to FIG. 2, a second embodiment of the present invention will be described. In the following description, components similar to those of the first embodiment will be indicated by the same reference numerals and will not be described further for the sake of simplicity. In the injector 1 according to the second embodiment, the needle 2 does not have the communication passage 46, which is described with reference to the first embodiment. As shown in FIG. 2, the nozzle chamber 23 communicates with the first internal chamber 17 (specifically, the outer peripheral chamber 17*a*) through a communication passage (communication hole) 49, which is provided in the body 10. With this construction, the high pressure fuel directly flows from the first internal chamber 17 into the nozzle chamber 23 without passing through the backpressure chamber 41.

Now, modifications of the above embodiments will be described.

Figure 3:
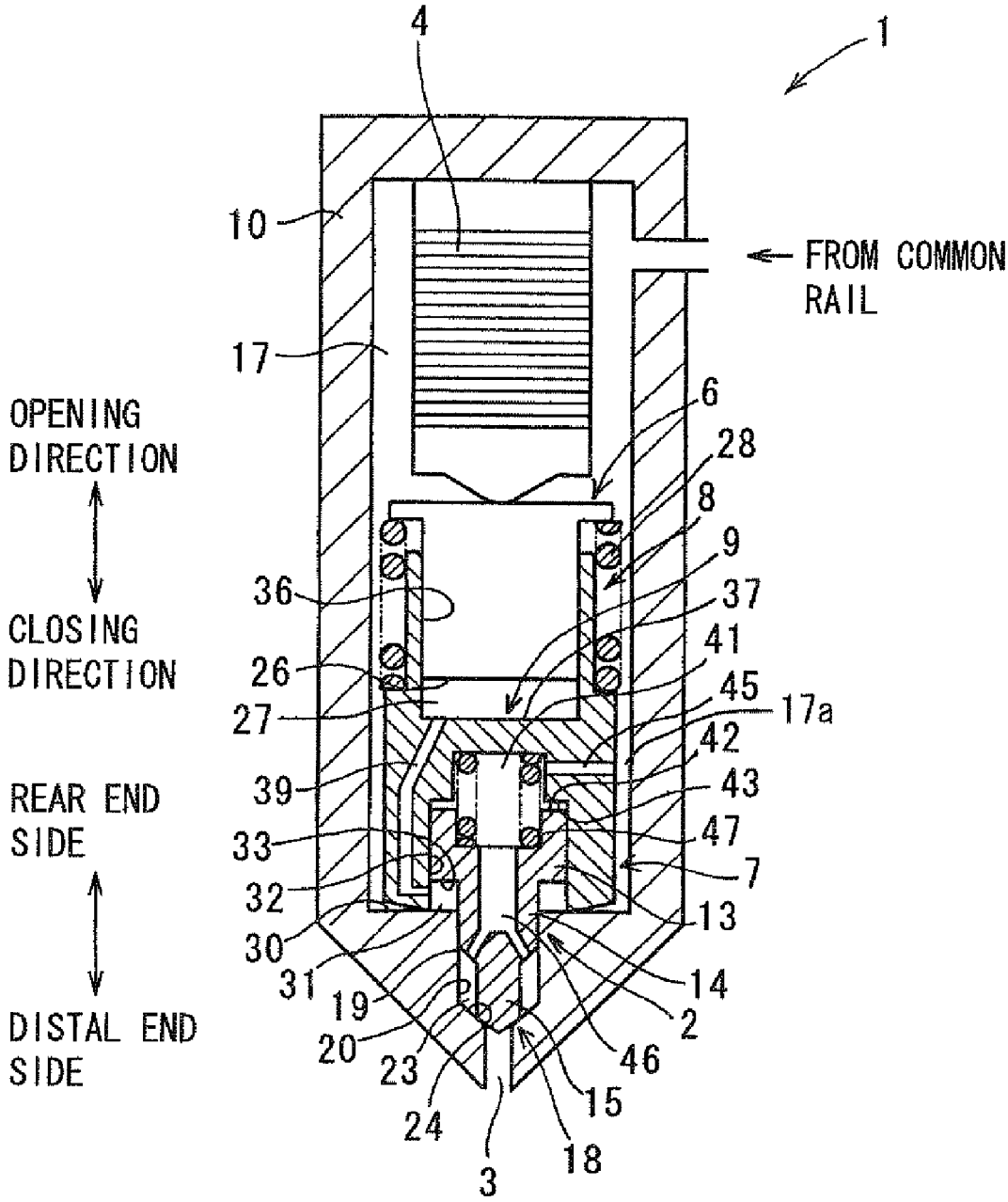
FIG. 3 is a schematic longitudinal cross sectional view showing a modification of the first embodiment.
Figure 4:
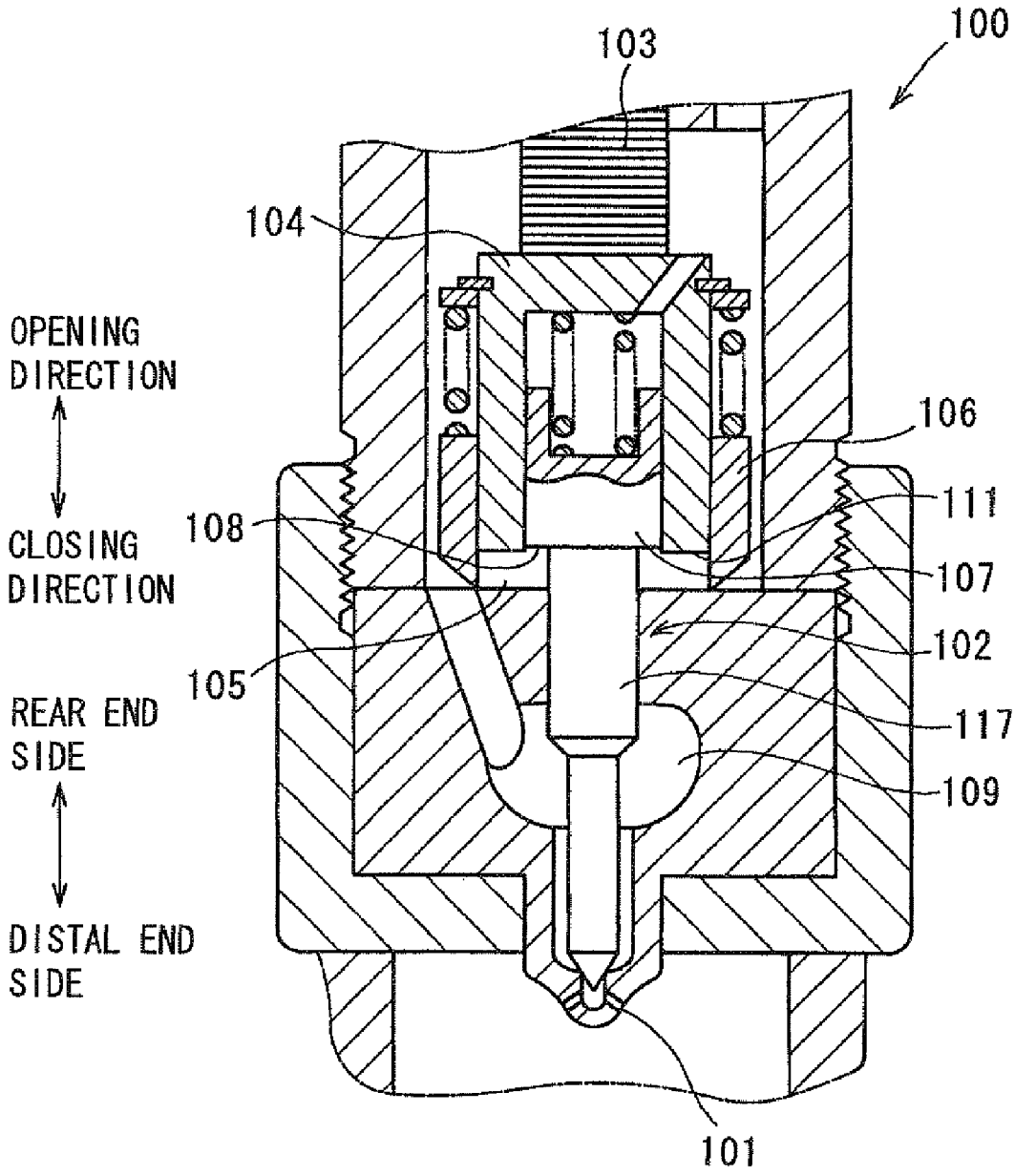
FIG. 4 PRIOR ART
FIG. 4 is a partial enlarged cross sectional view of a prior art injector, in which a piston and a first shaft portion are arranged parallel to each other.
Figure 5A:
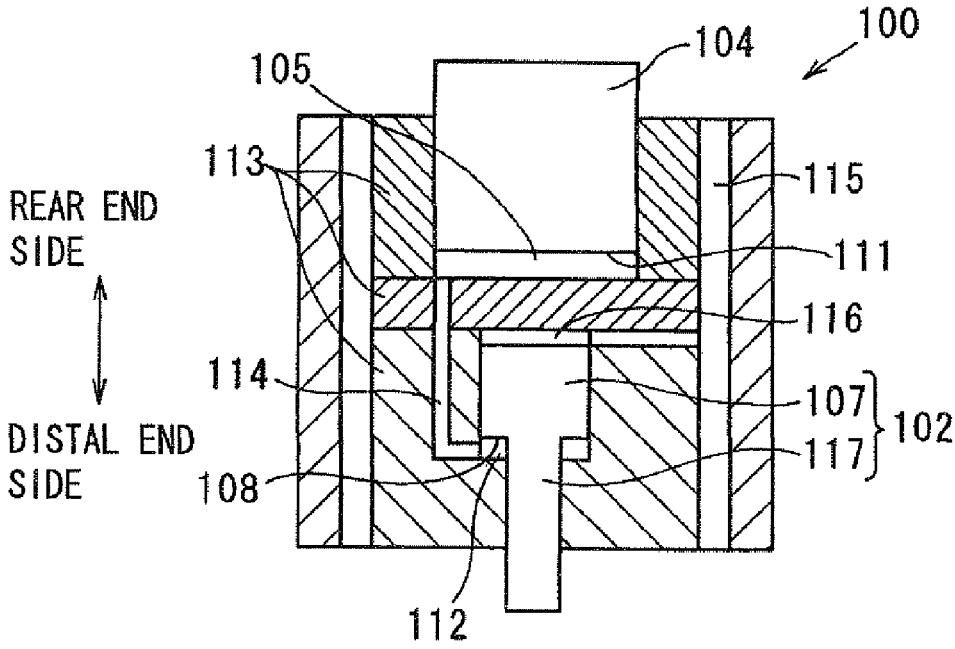
FIG. 5A PRIOR ART
FIG. 5A is a schematic diagram showing one operational position of another prior art injector, in which a piston and a first shaft portion are arranged in series.
Figure 5B:
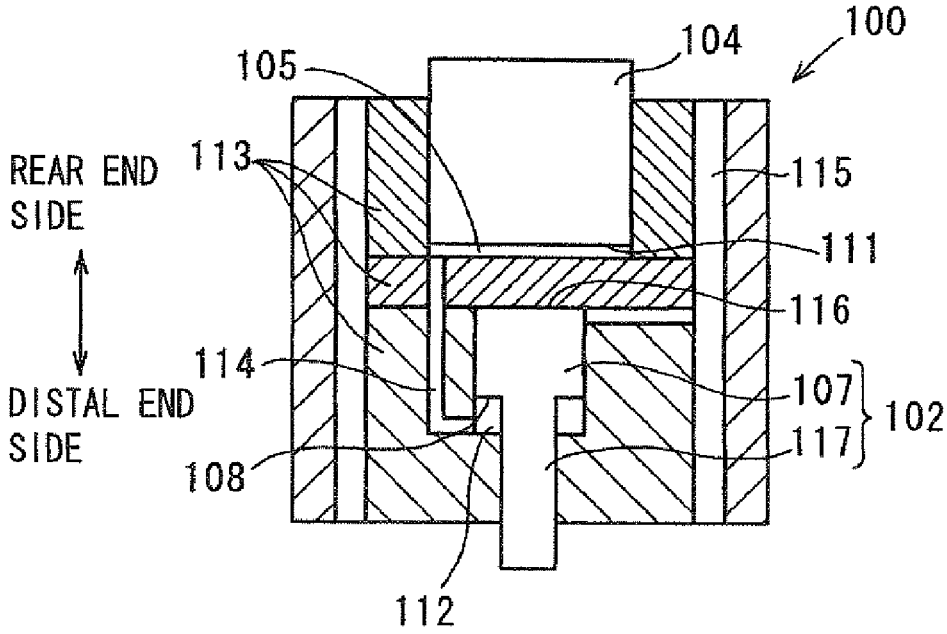
FIG. 5B PRIOR ART
FIG. 5B is a schematic diagram showing another operational position of the prior art injector of FIG. 5A.

According to the injector 1 of the first and second embodiments, all of the first sleeve 7, the second sleeve 8 and the flange 9 are separately formed. Alternatively, the first sleeve 7 and the flange 9 may be formed integrally, and the second sleeve 8 and the flange 9 may be formed integrally. Also, all of the first sleeve 7 the second sleeve 8 and the flange 9 may be formed integrally as shown in FIG. 3. In this case, it is possible to reduce the number of the components of the injector 1.

In the injector 1 of the first and second embodiments, the distal end portion of the flange 9 is fitted into the first sleeve 7, and the rear end portion of the flange 9 is fitted into the second sleeve 8. Alternatively, the first sleeve 7 and the flange 9 may be configured such that the first sleeve 7 is fitted into the flange 9. Also, the second sleeve 8 and the flange 9 may be configured such that the second sleeve 8 is fitted into the flange 9.

In the injector 1 of the first and second embodiments, the actuator 4 is formed of the piezoelectric element. Alternatively, a magnetostrictor, which is expanded by generation of a magnetic field, may also be employed to form the actuator 4. Additional advantages and modifications will readily occur to those skilled in the art. The invention in its broader terms is therefore not limited to the specific details, representative apparatus, and illustrative examples shown and described.

What is claimed is:

1. An injector comprising:

a needle that is slidable in a valve opening direction and a valve closing direction to respectively open and close an injection hole, which is located at a distal end side of the injector, wherein the needle includes a first shaft portion and a second shaft portion, which are separately supported in an axially slidably manner, and the second shaft portion is located on a distal end side of the first shaft portion and has an outer diameter smaller than that of the first shaft portion;

a sleeve that slidably supports the first shaft portion;

a body that loosely receives the sleeve therein;

an actuator that axially expands and contracts to drive the needle;

a piston that is axially moved forward and backward in response to expansion and contraction, respectively, of the actuator; and a control chamber, in which a fuel pressure is increased and decreased in response to forward movement and backward movement, respectively, of the piston, wherein:

the control chamber applies the fuel pressure to the first shaft portion in the valve opening direction of the needle;

when the actuator is expanded, the piston is moved forward to increase the fuel pressure in the control chamber, so that the needle is lifted away from the injection hole to open the injection hole; and when the sleeve is urged toward the distal end side and is thereby seated against an internal surface of the body, the control chamber is defined by an inner peripheral surface of the sleeve, the internal surface of the body, an outer peripheral surface of the second shaft portion of the needle and a distal end surface of the first shaft portion, wherein:

the sleeve is a first sleeve; and the injector further comprises a second sleeve, which slidably receives the piston, and a flange, which is located on a distal end side of the piston and defines a pressure chamber in cooperation with the piston and the second sleeve;

a fuel pressure of the pressure chamber is increased and decreased in response to the forward movement and the backward movement, respectively, of the piston;

the second sleeve and the flange are located on a rear end side of the first sleeve and are loosely received in the body;

the control chamber is communicated with the pressure chamber through a communication passage, so that the fuel pressure of the control chamber is increased and decreased in response to the forward movement and the backward movement, respectively, of the piston; and the communication passage between the control chamber and the pressure chamber penetrates through the flange and the first sleeve and is separated from an outer peripheral chamber that is defined between an inner peripheral surface of the body and outer peripheral surfaces of the flange and of the first sleeve.

2. The injector according to claim 1, wherein the second shaft portion is slidably supported by the body on a distal end side of the sleeve.

3. The injector according to claim 1, further comprising a first urging means for urging the second sleeve and the piston in opposite axial directions, respectively.

4. The injector according to claim 1, wherein:

the first sleeve, the flange and the second sleeve are placed adjacent to one another and are loosely received in the body in this order from the distal end side toward a rear end side of the injector; and the first sleeve is seated against the internal surface of the body when the second sleeve is urged toward the distal end side to urge the first sleeve toward the distal end side.

5. The injector according to claim 1, further comprising a backpressure chamber, which receives fuel to exert a fuel pressure on the needle in the valve closing direction, wherein the backpressure chamber is communicated with the outer peripheral chamber through a communication passage, which is formed in the flange, so that fuel flows into and out of the backpressure chamber through the outer peripheral chamber and the communication passage of the flange.

6. The injector according to claim 5, further comprising a nozzle chamber, which receives fuel to exert a fuel pressure on the needle in the valve opening direction, wherein:

a communication between the injection hole and the nozzle chamber is opened and closed by a distal end portion of the needle; and the backpressure chamber is communicated with the nozzle chamber.

7. The injector according to according to claim 5, wherein the backpressure chamber is defined by the first sleeve, the needle and the flange.

8. The injector according to claim 5, wherein a rear end surface of the needle, which is opposite from the injection hole, receives the fuel pressure of the backpressure chamber in the valve closing direction.

9. The injector according to claim 5, further comprising a second urging means for urging the needle in the valve closing direction, wherein the second urging means is received in the backpressure chamber.

10. The injector according to claim 1, wherein one of the flange and the first sleeve is fitted into the other one of the flange and the first sleeve, so that the flange and the first sleeve are radially positioned relative to each other.

11. The injector according to claim 1, wherein one of the second sleeve and the flange is fitted into the other one of the second sleeve and the flange, so that the second sleeve and the flange are radially positioned relative to each other.

12. The injector according to claim 1, wherein:

the first sleeve, the flange and the second sleeve are arranged adjacent to one another and are placed one after another in this order from the distal end side toward the rear end side of the injector; and at least axially adjacent two of the first sleeve, the flange and the second sleeve are formed integrally.

13. The injector according to claim 1, wherein:

the piston is axially spaced from the needle;

the injection hole extends through a wall of the body; and the second shaft portion is directly slidably supported by an inner peripheral surface of the body.

* * * * *